US005996125A

United States Patent [19]

Garzone

[11] Patent Number: 5,996,125

[45] Date of Patent: Dec. 7, 1999

[54] HARD HAT WITH OPAQUE CROWN AND TRANSPARENT BILL

[75] Inventor: Robert J. Garzone, Travelers Rest, S.C.

[73] Assignee: Garzone International Corporation, Traveler's Rest, S.C.

[21] Appl. No.: 09/085,792

[22] Filed: May 28, 1998

[51] Int. Cl.[6] ..... A42B 3/22

[52] U.S. Cl. ..... 2/410; 2/10; 2/195.1; 2/200.1

[58] Field of Search ..... 2/6.3, 6.7, 10, 2/410, 195.1, 200.1

[56] References Cited

U.S. PATENT DOCUMENTS

| | | | |
|---|---|---|---|
| 911,432 | 2/1909 | Pachner . | |
| 1,266,503 | 5/1918 | Liederman . | |
| 1,519,590 | 12/1924 | Mull . | |
| 3,707,004 | 12/1972 | Kapitan et al. | 2/2.5 |
| 4,030,140 | 6/1977 | Burt | 2/410 |
| 4,975,981 | 12/1990 | Ray | 2/10 |
| 5,056,156 | 10/1991 | Kosmo et al. | 2/2.1 |
| 5,101,517 | 4/1992 | Douglas | 2/424 |

OTHER PUBLICATIONS

Perceptual and Motor Skills, 1994, p. 1535–1538. Title—"Superiority of Clear–Visor Safety Hat To Opaque–Visor Hat: An Evaluation of Upper Visual–Field Obstruction".

MSA Data Sheet No. 06–00–01 (1993) 4 pages.

*Primary Examiner*—Diana Oleksa
*Attorney, Agent, or Firm*—Henry S. Jaudon; Cort Flint

[57] ABSTRACT

A molded plastic safety hat comprised of an opaque crown and a transparent bill. The crown which is molded of a polycarbonate polymer, includes a dome and a brim. The dome includes an inner area adapted to receive a wearer's head. The bill comprises a unitary molded plastic member molded of a polycarbonate polymer which is connected along one edge with the crown at the brim. The bill is positioned to project outwardly and slightly downwardly from the crown into a position which extends over the wearer's eyes and face. Because the bill is transparent, the wearer is allowed continuous unobstructed substantially vertical, direct, and peripheral vision without tilting the head or rearranging or removing the safety hat from it's proper position.

17 Claims, 3 Drawing Sheets

HARD HAT WITH OPAQUE CROWN AND TRANSPARENT BILL

BACKGROUND OF THE INVENTION

This invention relates to safety hats as used by workers in areas which have been deemed to be unsafe by the government (OSHA). Generally, these safety hats are identified as hard hats and bump hats. The use of both type hats is well known and does not form a part of the instant invention.

In the past, most safety hats were made of metal. Now they tended to be molded of plastic which is both lightweight and has a very high impact strength. In either case, the forming material has been opaque and usually of a specific color which identifies the job and the position of the wearer.

It is required that safety hats be constructed with a dome, which fits well down on the head, and have at least a bill which projects outwardly from the dome to extend over the eyes and face of the wearer. This structure provides the necessary protection for the head and face. Using the discussed forming materials, this structure blocks completely any upward or peripheral upward vision. As a result, many times safety hats are worn backwards or worse are removed when vertical vision is a usual necessity. Such practice is in violation of work regulations.

It is an object of this invention to provide a safety hat which eliminates the need for improperly wearing or removal on the job by allowing upward or vertical vision.

Another object of the invention is a safety hat which allows upward vision without tilting of the wearer's head.

Another object of the invention is a safety hat having a transparent bill and a opaque crown which structurally satisfies all safety requirements.

Another object of the invention is the provision of a molded unitary plastic safety hat with an opaque crown and a transparent bill.

Another object of the invention is a safety hat which allows an upward peripheral vision.

Another object of the invention is a safety hat molded of transparent plastic with a colored plastic film laminated over the crown area.

Another object of the invention is a safety hat molded of transparent plastic having the crown area colored with an identifying paint or powder.

SUMMARY OF THE INVENTION

The invention is directed to a molded one-piece plastic safety hat formed with an opaque crown and a transparent bill. The crown includes a lower brim and a dome molded of plastic material. The inner area of the dome forms a space adapted to receive a wearer's head. The bill, which is also molded of plastic material, is integral with the crown at the brim. The bill is arranged to project outwardly and slightly downwardly into a position which extends above the wearer's face and eyes. Because the bill is transparent, it allows upward vision and upward peripheral vision while the safety hat is properly worn without substantial rearward tilting of the head.

The safety hat is molded of a polycarbonate polymer or of a blended polyamide polymer. The crown may be made opaque by laminating a colored plastic film onto the crown or by applying a powder coating onto a surface thereof.

The safety hat may be constructed as a hard hat or a bump hat to include an outer shell formed with an opaque crown and brim and a transparent bill. The crown includes a unitary molded plastic dome with an inner area adapted to receive a wearer's head. The bill comprises a unitary molded plastic member connected at one side with the outer brim. The bill is positioned to project outwardly and slightly downwardly from the crown into a position which extends over the wearer's eyes and face. The transparent bill allows unobstructed substantially vertical sight without rearranging or removing the safety hat from it's proper position on the head.

The bill may be connected with the brim by gluing, fusing, welding, bolting, or riveting. When the bill connected to a pre-formed crown, the crown is molded with opaque plastic material. When the safety hat is molded as one piece, the forming plastic material is transparent. The transparent crown is rendered opaque by powder coating, or laminating with a sheet of opaque plastic.

DESCRIPTION OF THE DRAWINGS

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
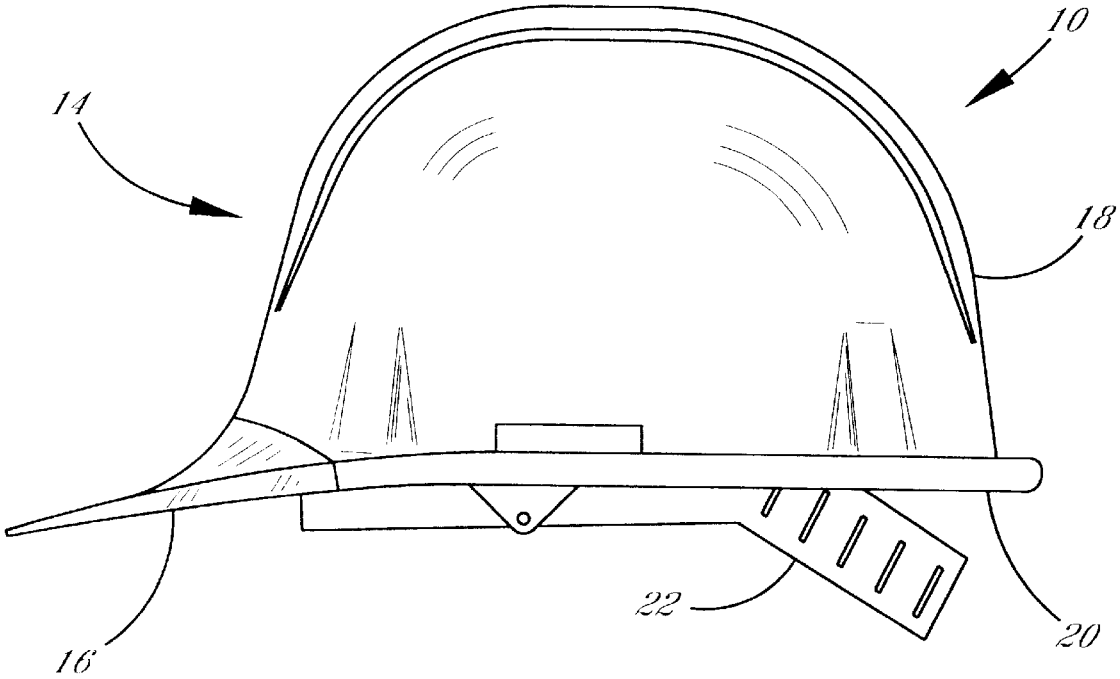
FIG. 1 is a side view of a hard hat constructed in accordance with the invention.
Figure 2:
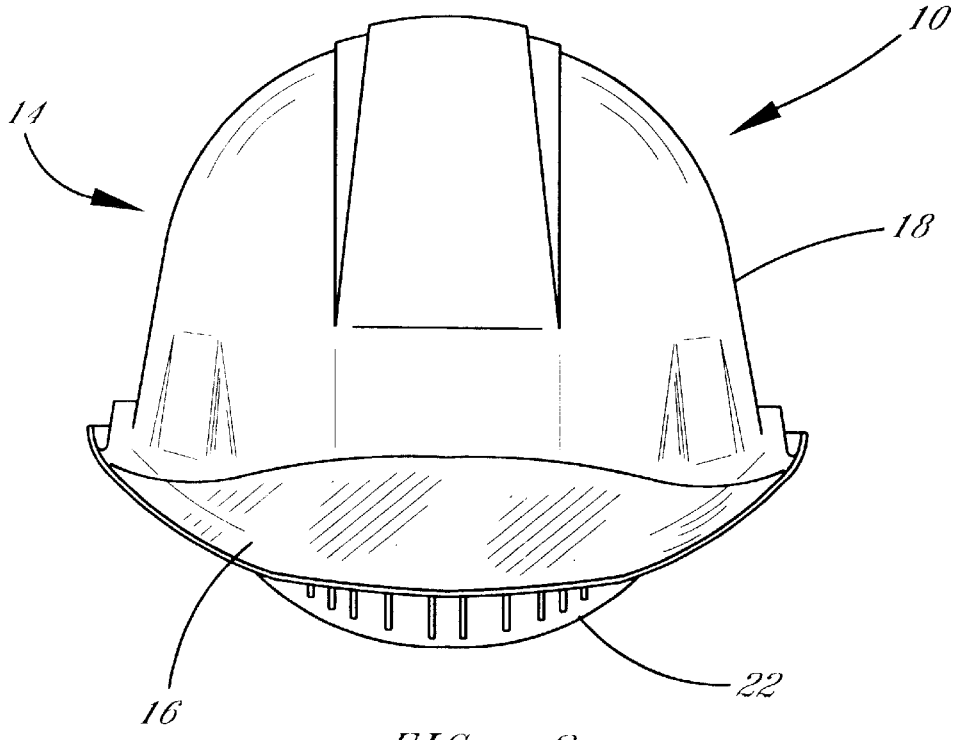
FIG. 2 is a front view of the hard hat of FIG. 1.
Figure 3:
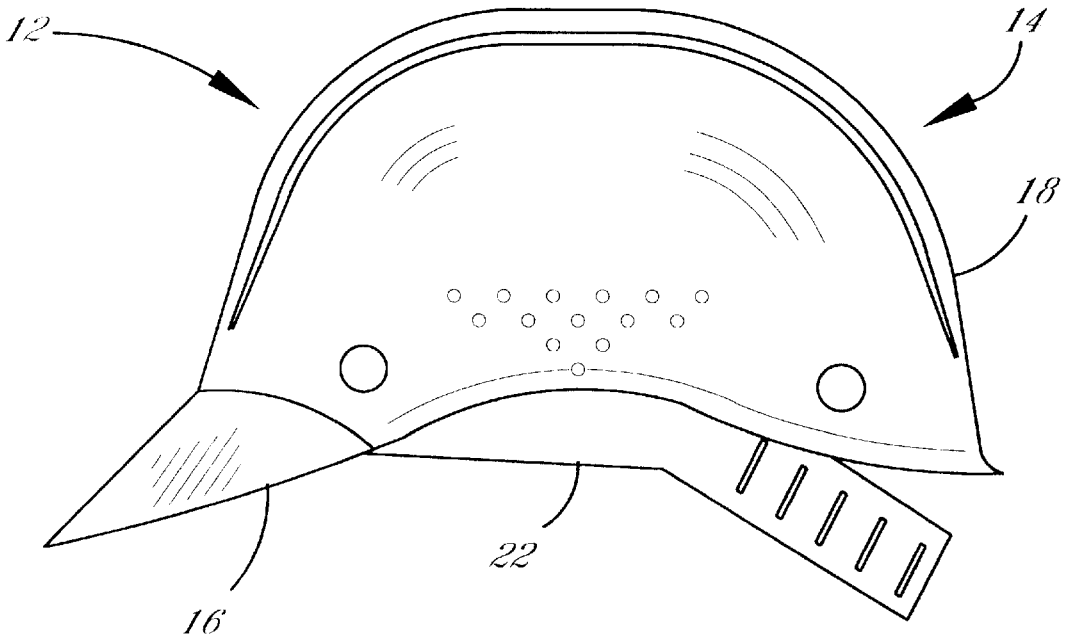
FIG. 3 is a side view of a bump hat constructed in accordance with the invention.
Figure 4:
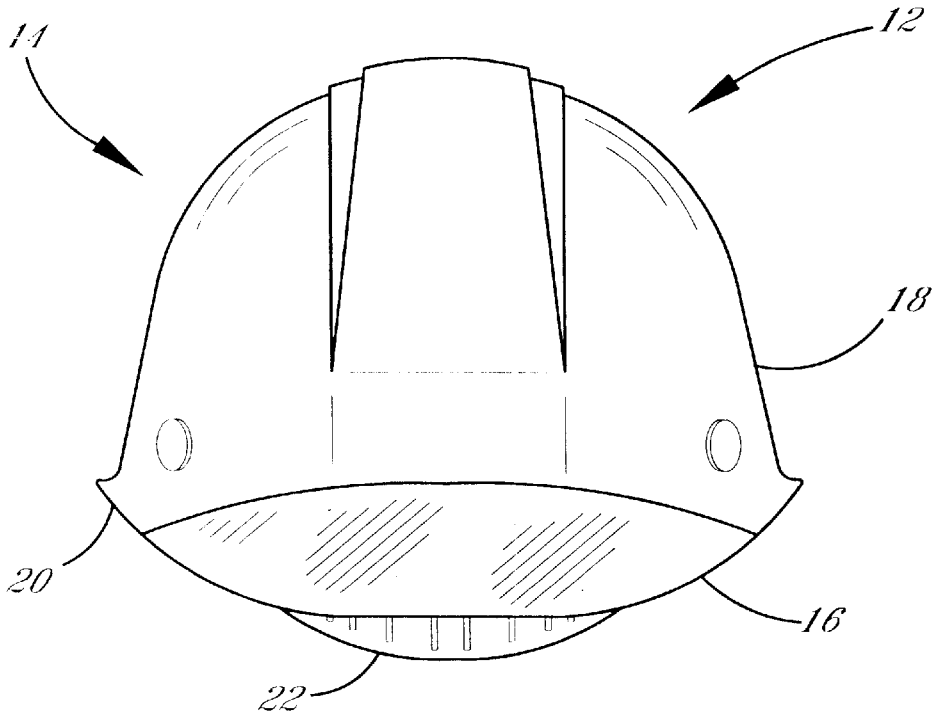
FIG. 4 is a front view of the bump hat of FIG. 3.

Turning now to the drawings, FIGS. 1 and 3 show safety hats 10 and 12 made according to the invention. Safety hat 10, which may be of the type referred to as a hard hat is shown in FIGS. 1 and 2 while safety hat 12 may be of the type referred to as a bump hat and is shown in FIGS. 3 and 4. Both types of safety hats are formed of molded plastic material configured to include a crown 14 and a bill 16. Crown 14 includes dome 18 and brim 20. Bill 16 is attached to or formed integral with brim 20 to extend slightly downward and outward therefrom into a position which covers and protects the wearer's face and eyes from falling objects and other safety hazzards such as beams.

Safety hats, in specified type work environment, are a requirement of the federal government (OSHA) along with various state agencies and insurance companies. These agencies have enacted regulations dictating the design, the impact strength of the forming material, and finally a proper wearing position. When any one of these requirements is detected not being observed, it normally results in penalties against the employer and/or employee.

A most common violation is the wearing of the safety hat improperly or wearing the safety hat so that the bill is located at the back of the head. Normally these situations occur when vision, both direct and peripheral, in an upward or vertical direction is frequently required such as in building construction or as in assembly plants such as automobiles. A major reason for wearing the safety hat improperly in these conditions is the loss if upward peripheral vision or the ability to see out of the corner of the eye.

Safety hats 10 and 12 preferably are formed by injection molding of a polycarbonate resin such as B56, B69, or B71 all of which are approved by OSHA. Another approved plastic is a polyamide resin blend AVS. Of course any synthetic resin which produces a safety hat which satisfies the OSHA requirements and is normally transparent is acceptable.

As molded, safety hats 10 and 12 are normally formed with a transparent crown 14, having a dome 18 whose inner area carries the usual head support straps 22 are mounted. Bill 16 is normally formed integral with crown 14 at brim 20 and is also formed of the transparent plastic resin.

Figure 6:
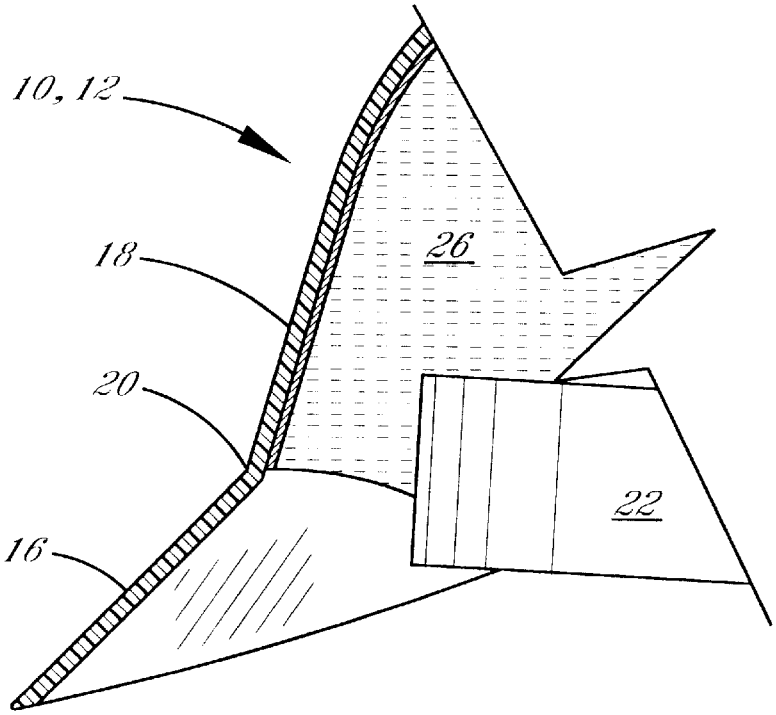
FIG. 6 is a sectional side view showing the bill and crown formed integral with a opaque liner secured with the crown.

As shown in FIG. 6, an opaque coating 26 is applied or secured with dome 18 as a sun block and to provide color for a color coded index indicative of the work position of the wearer. Coating 26 may be in the form of a colored plastic film laminated to the inner or outer surface of the dome. Alternatively, the coloring material may take the form of powder coating applied to either of the exposed surfaces as selected.

Coating 26 is preferably secured with the inner surface of dome 18 which protects it against scratching and peeling. Alternatively, it has been found that the coating may be secured with the outer surface of the dome with satisfactory results.

Figure 5:
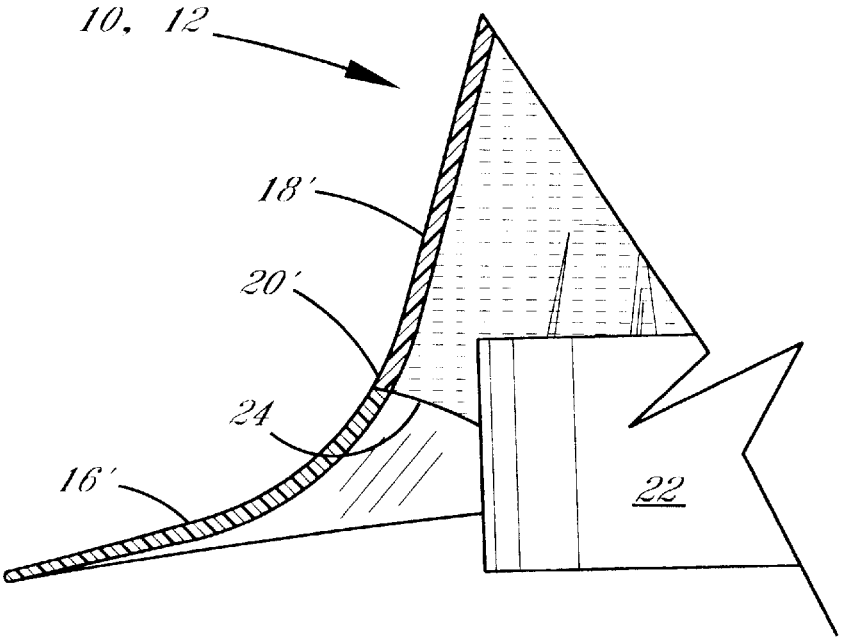
FIG. 5 is a sectional side view showing the transparent bill secured with the opaque crown.

An alternative structure of the safety hats is illustrated in FIG. 5. Here safety hats 10 or 12 are formed with a molded dome 18', of usual construction, formed of an opaque plastic. Bill 16' is formed separately of a transparent plastic material. Bill 16' is then united with the edge of brim 20' at 24 by fusing, welding, gluing, or other known means. The only requirement is that joinder 24 be of sufficient strength to meet the OSHA impact strength requirements.

Another manner of joining bill 16 with dome 18 would be with mechanical means such as bolts or brads.

It is also contemplated that the safety hat having the opaque dome and transparent bill could be molded in a one step process using opaque and transparent resins. The process isolates the opaque resins to the dome area and the transparent resins to the bill area and molds the two together at the point of joinder.

In practice, with the safety hat in its proper position, the wearer has direct vision or indirect peripheral vision in an upward or vertical direction at all times. This is a tremendous improvement in the safety provided by the safety hat because now one's peripheral vision is able to pick up objects, which otherwise would not be seen, allowing for reactive, instantaneous, and appropriate movement. Also, the need to improperly position the safety hat on the head is removed thus eliminating a most common safety violation. With this improved construction of safety hats, it is envisioned that safety in the work place will be greatly enhanced.

While preferred embodiments of the invention has been described using specific terms, such description is for illustrative purposes only, and it is to be understood that changes and variations may be made without departing from the spirit or scope of the following claims.

What is claimed is:

1. A one-piece safety hat of molded plastic having an inner and an outer surface comprising a crown with a transparent bill;

said crown being laminated on one of said surfaces with an opaque plastic forming said crown opaque;

said crown including a lower brim and a dome, said dome having an inner area adapted to receive a wearer's head;

said bill is formed integral with said crown at said brim and, projects outwardly into a position which is adapted to extend above a wearer's face and eyes; whereby, said opaque plastic laminating said crown may be colored for job identification while said bill remains transparent allowing continuous upward, direct, and peripheral vision with said safety hat properly positioned on a wearer's head.

2. The hat of claim 1 wherein said plastic is a polycarbonate polymer.

3. The hat of claim 1 wherein said opaque plastic is laminated to said inner surface of said crown.

4. The hat of claim 1 wherein said plastic is a blended polyamide polymer.

5. The hat of claim 1 wherein said safety hat is a hard hat.

6. The hat of claim 1 wherein said safety hat is a bump hat.

7. The hat of claim 1 wherein said transparent bill is tinted.

8. A molded plastic safety hat having an outer shell comprising an opaque crown and a transparent bill;

said crown includes a unitary molded plastic dome and brim, said dome forming an inner area adapted to receive a wearer's head;

said bill comprises a unitary molded plastic member connected at one side with said brim in position to extend outwardly and slightly downwardly there from into a position over a wearer's eyes and face; whereby, a wearer, with the safety hat properly positioned, has continuous unobstructed substantially vertical sight, both direct and peripheral, without substantial tilting of the head.

9. The hat of claim 8 wherein said crown is molded of a polycarbonate polymer.

10. The hat of claim 9 wherein said bill is riveted with said crown.

11. The hat of claim 9 wherein an opaque powder coating is laminated with said inner area of said crown.

12. The hat of claim 9 wherein said crown includes a sheet of opaque plastic laminated thereto.

13. The hat of claim 8 wherein said safety hat is selected from the group consisting of a hard hat and a bumper hat.

14. The hat of claim 8 wherein said transparent bill is tinted.

15. The hat of claim 8 wherein said bill is fused to said crown.

16. The hat of claim 8 wherein said bill is welded to said crown.

17. A one-piece safety hat of molded plastic having an inner and an outer surface comprising a crown with a transparent bill;

said crown being laminated on one of said surfaces with an opaque powder coating;

said crown includes a lower brim and a dome, said dome having an inner area adapted to receive a wearer's head;

said bill, formed integral with said crown at said brim, projects outwardly from said brim into a position which is adapted to extend above a wearer's face and eyes; whereby, said opaque powder coating laminating said crown may be colored for job identification while said bill remains transparent allowing continuous upward, direct, and peripheral vision with said safety hat properly positioned on a wearer's head.

* * * * *